US009834229B2

(12) United States Patent
Traintinger et al.

(10) Patent No.: US 9,834,229 B2
(45) Date of Patent: Dec. 5, 2017

(54) RAIL-LOADING TRAIN FOR TRANSPORTING LONG-WELDED RAILS COMPRISING CLAMPING DEVICES FOR THE RAIL SECTIONS

(71) Applicant: ROBEL BAHNBAUMASCHINEN GMBH, Freilassing (DE)

(72) Inventors: Bernhard Traintinger, Anthering (AT); Raimund Machatschek, Bad Vigaun (AT)

(73) Assignee: Robel Bahnbaumaschinen GmbH, Freilassing (DE)

( * ) Notice: Subject to any disclaimer, the term of this patent is extended or adjusted under 35 U.S.C. 154(b) by 69 days.

(21) Appl. No.: 14/891,971

(22) PCT Filed: Apr. 29, 2014

(86) PCT No.: PCT/EP2014/001147
§ 371 (c)(1),
(2) Date: Nov. 18, 2015

(87) PCT Pub. No.: WO2014/187528
PCT Pub. Date: Nov. 27, 2014

(65) Prior Publication Data

US 2016/0096533 A1 Apr. 7, 2016

(30) Foreign Application Priority Data

May 18, 2013 (DE) ..... 20 2013 004 729 U

(51) Int. Cl.
*B61D 3/00* (2006.01)
*B61D 3/16* (2006.01)
*E01B 29/17* (2006.01)

(52) U.S. Cl.
CPC ..... *B61D 3/16* (2013.01); *E01B 29/17* (2013.01)

(58) Field of Classification Search
CPC B61D 3/16; B61D 3/166; E01B 29/17; E01B 29/20
See application file for complete search history.

(56) References Cited

U.S. PATENT DOCUMENTS 8,419,327 B2 * 4/2013 Muehlbacher ..... E01B 29/17 410/32
8,708,625 B1 * 4/2014 Landrum ..... B60P 3/40 410/44
2008/0232917 A1 * 9/2008 Hertelendi ..... E01B 29/17 410/2
2012/0114443 A1 * 5/2012 Cyrus ..... B60P 3/40 410/44

(Continued)

FOREIGN PATENT DOCUMENTS

WO 2007065500 A1 6/2007
WO 2010127735 A1 11/2010

*Primary Examiner* — Jason C Smith
(74) *Attorney, Agent, or Firm* — Laurence A. Greenberg; Werner H. Stemer; Ralph E. Locher

(57) ABSTRACT

Arranged on a rail loading train for transporting long-welded rails is a fixing device for anchoring the rails. The fixing device is composed of a number of clamping devices, each provided for anchoring a single rail. The clamping devices are configured to be adjustable relative to the rail loading train in a longitudinal direction of the wagon by a displacement drive.

7 Claims, 2 Drawing Sheets

(56) References Cited

U.S. PATENT DOCUMENTS

| | | | | |
|---|---|---|---|---|
| 2013/0343827 | A1* | 12/2013 | Schibsbye | B60P 3/40 410/45 |
| 2014/0255119 | A1* | 9/2014 | Herzog | B61D 3/16 410/44 |
| 2016/0052528 | A1* | 2/2016 | Lichtberger | B61D 15/00 414/339 |
| 2016/0053740 | A1* | 2/2016 | Landrum | F03D 1/005 414/800 |
| 2016/0096533 | A1* | 4/2016 | Traintinger | B61D 3/16 105/355 |

* cited by examiner

RAIL-LOADING TRAIN FOR TRANSPORTING LONG-WELDED RAILS COMPRISING CLAMPING DEVICES FOR THE RAIL SECTIONS

BACKGROUND OF THE INVENTION

Field of the Invention

The invention relates to a rail loading train for transporting long-welded rails, including loading wagons mobile on a track and a fixing device for anchoring the rails, the fixing device being arranged on the rail loading train and composed of a number of clamping devices provided for anchoring a single rail in each case.

Rail loading trains of this type are already known from WO 2007/065500 A1 or WO 2010/127735 A1. These consist of several loading wagons, with a crane being arranged for mobility on rails along said wagons. Long-welded rails to be transported are anchored in a fixing device arranged on the rail loading train, wherein a separate clamping device is associated with each rail.

BRIEF SUMMARY OF THE INVENTION

It is the object of the present invention to provide a rail loading train of the type mentioned at the beginning, the loading of which can be accomplished as universally and independently as possible.

According to the invention, this object is achieved with a rail loading train of the specified type in that the clamping devices are designed to be adjustable in a longitudinal direction of the wagon relative to the rail loading train by means of a displacement drive.

A rail loading train equipped in this manner can now be loaded at the rail welding plant largely independently of the particular situation at the construction site, but, above all, without being limited by the local conditions. At said rail welding plant, operation of the gantry crane belonging to the rail loading train is often possible only in a very limited way or not at all. At the plant, the rails are merely positioned immediately in front of the fixing device. The actual contact between the clamping device and the rail is established by displacing the fixing device.

Additional advantages of the invention become apparent from the dependent claims and the drawing description.

DESCRIPTION OF THE INVENTION

Figure 1:
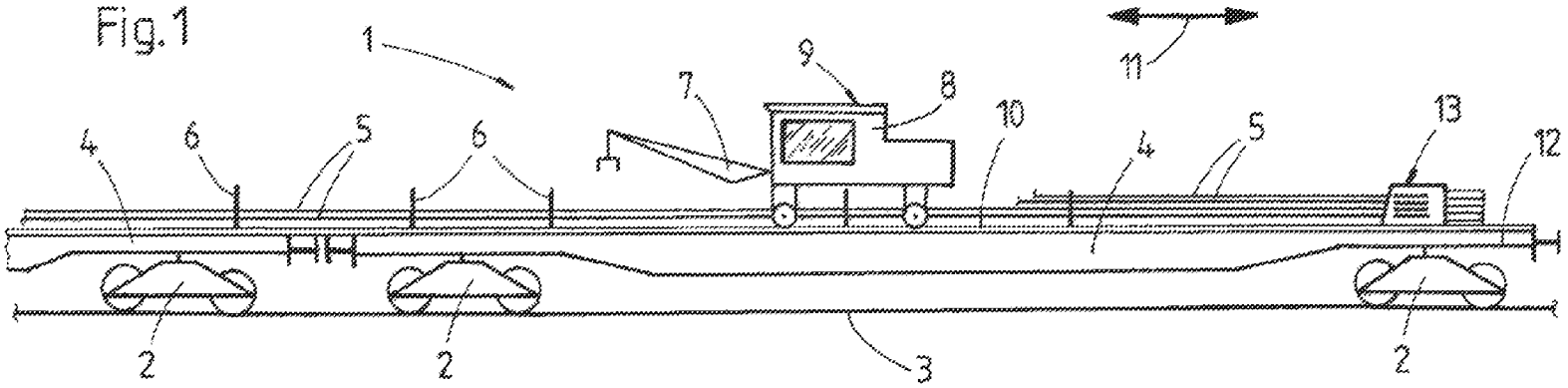
FIG. 1 shows a schematic side view of a rail loading train.

A rail loading train 1 shown in FIG. 1 is composed of a number of loading wagons 4, mobile by means of on-track undercarriages 2 on a track 3, and serves for transporting long-welded rails 5. These are stored in the known manner in several layers, arranged one above the other, on support racks 6. Provided for loading and unloading the rails 5 is a crane 9, having a jib 7 and a cabin 8, which is freely mobile along the loading wagons 4 on crane rails 10 and displaces the long-welded rails 5 in a longitudinal direction 11 of the wagon. At one end 12 of the rail loading train 1 (preferably at both ends), a fixing device 13 for anchoring the rails 5 during transport is located.

Figure 2:
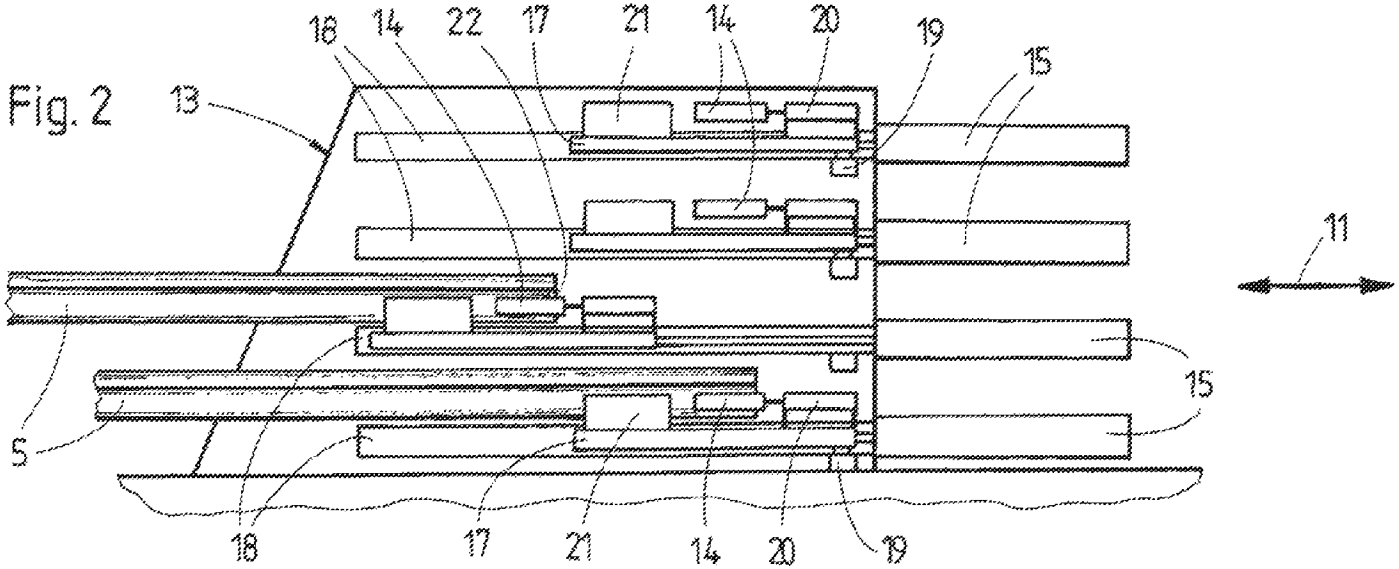
FIGS. 2 and 3 each show a simplified side view and top view, respectively, of a fixing device for anchoring rails.
Figure 3:
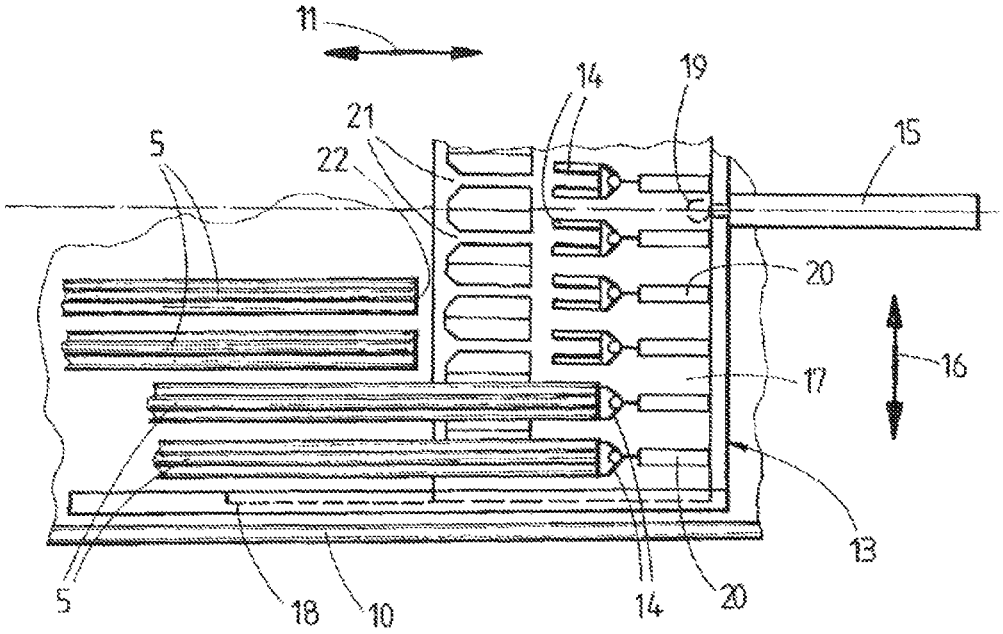

As shown in more detail in FIGS. 2 and 3, the fixing device 13 is composed of several clamping devices 14, each provided for anchoring a single rail 5, which are designed to be adjustable by means of a displacement drive 15 relative to the rail loading train 1 in the longitudinal direction 11 of the wagon. As visible in particular in FIG. 3, a number of clamping devices 14—arranged next to one another in a transverse direction 16 of the wagon—are mounted on a common carrier plate 17 which is adjustable in the longitudinal direction 11 of the wagon by means of the displacement drive 15. FIG. 2 shows clearly that the fixing device 13 has a number of carrier plates 17 arranged one above the other, each designed to be adjustable independently of the others in the longitudinal direction 11 of the wagon by means of displacement drives 15. Associated with each carrier plate 17 is a longitudinal guide 18 connected to the fixing device 13. Each carrier plate 17 has a locking device 19 for fixing the carrier plate 17 to the fixing device 13 or to the rail loading train 1.

Based on the permitted axle load, load carrying capacity and width of the wagon, a configuration of the rail loading train 1 with a total of four carrier plates 17 having ten clamping devices 14 each, i.e. for forty long-welded rails 5, proves especially advantageous.

As far as the design of the clamping device 14 is concerned, reference is made to the state of the art cited at the beginning. Each clamping device 14 has a separate drive 20 for anchoring the rail 5. Furthermore, a sliding device 21 for inserting and guiding the rail 5 is associated with each clamping device 14.

The manner of operation of the fixing device 13 will now be described briefly. As already mentioned, operation of the crane 9 is not always possible. In these cases, the rails 5 are transported in pairs to immediately in front of the sliding devices 21 by a transport device not further shown. By actuation of the displacement drive 15, the carrier plate 17 moves slidingly in the longitudinal guide 18 in the longitudinal direction 11 of the wagon towards the ends 22 of the rails 5. With the aid of the sliding devices 21, the rails 5 are centred and arrive with their ends 22 in the clamping devices 14. By actuation of the drives 20, the two rails 5 are fixed to the fixing device 13 or to the rail loading train 1. After renewed actuation of the displacement drive 21, the rails 5 are moved slightly in the direction towards the end 12 of the rail loading train 1. Now, the next pair of rails 5 is inserted, until the entire carrier plate 17 is furnished with rails 5. After the last displacement of the carrier plate 17 in the direction towards the end 12, the carrier plate 17 is fixed to the fixing device 13 with the aid of the blocking device 19, and the loading operation of the next carrier plate 17 can proceed.

The invention claimed is:

1. A rail loading train for transporting long-welded rails, the rail loading train comprising:

a mobile loading wagon disposed on a track;

a displacement drive; and a fixing device for anchoring the long-welded rails, said fixing device disposed on said mobile loading wagon and composed of a drive and a number of clamping devices each provided for anchoring a single one of the long-welded rails by means of said drive, said clamping devices are configured to be adjustable in a longitudinal direction of said mobile loading wagon relative to the rail loading train by means of said displacement drive which is separate from said drive for anchoring a respective long-welded rail.

2. The rail loading train according to claim 1, further comprising a gliding device for inserting and guiding a long-welded rail, said gliding device associated with each of said clamping devices.

3. A rail loading train for transporting long-welded rails, the rail loading train comprising:

a mobile loading wagon disposed on a track;

a displacement drive;

a fixing device for anchoring the long-welded rails, said fixing device disposed on said mobile loading wagon and composed of a number of clamping devices each provided for anchoring a single one of the long-welded rails, said clamping devices are configured to be adjustable in a longitudinal direction of said mobile loading wagon relative to the rail loading train by means of said displacement drive; and a common carrier plate, said number of clamping devices are disposed one next to another in a transverse direction of said mobile loading wagon and are mounted on said common carrier plate, said common carrier plate is adjustable by means of said displacement drive in the longitudinal direction of said mobile loading wagon.

4. The rail loading train according to claim 3, wherein:

said displacement device is one of a plurality of displacement devices; and said common carrier plate is one of a plurality of carrier plates disposed one above the other, each of said carrier plates to be adjustable independently of the others in the longitudinal direction of said mobile loading wagon by said displacement drives.

5. The rail loading train according to claim 3, further comprising a longitudinal guide connected to said fixing device and associated with said carrier plate.

6. The rail loading train according to claim 4, wherein each of said carrier plates has a blocking device for fixing said carrier plates to said fixing device or to the rail loading train.

7. The rail loading train according to claim 4, wherein said fixing device has a total of four of said carrier plates, each having ten of said clamping devices.

* * * * *